United States Patent [19]

Acerbi

[11] 4,323,095

[45] Apr. 6, 1982

[54] BALANCED VALVE WITH UNIDIRECTIONAL OLEO-DYNAMIC UNLOCKING, IN PARTICULAR TO ALLOW A NUMBER OF HYDRAULIC ACTUATORS TO BE SERIES CONTROLLED AT HIGH PRESSURE

[75] Inventor: Leo Acerbi, Modena, Italy

[73] Assignee: Oil Control S.r.l., Modena, Italy

[21] Appl. No.: 166,829

[22] Filed: Jul. 8, 1980

[30] Foreign Application Priority Data

Jul. 11, 1979 [IT] Italy ..... 40086 A/79

[51] Int. Cl.[3] ..... F15B 13/01

[52] U.S. Cl. ..... 137/87; 91/420

[58] Field of Search ..... 91/420; 137/88, 106

[56] References Cited

U.S. PATENT DOCUMENTS 3,266,381 8/1966 Rohde ..... 91/420

FOREIGN PATENT DOCUMENTS 1943090 3/1971 Fed. Rep. of Germany ..... 91/420

2036547 1/1972 Fed. Rep. of Germany ..... 91/420

2536106 2/1977 Fed. Rep. of Germany ..... 91/420

*Primary Examiner*—Robert G. Nilson

*Attorney, Agent, or Firm*—Browdy & Neimark

[57] ABSTRACT

The invention relates to an improved and balanced valve with unidirectional hydraulic unlocking, in particular to allow a number of hydraulic actuators to be series controlled at high pressure.

This type of valve comprises: a check valve (11) and a unidirectional valve (14) with hydraulic unlocking; a pilot piston (17) acts on the closing mechanism (14*a*) of said valve (14) and is subjected, on a surface of a pre-established area, to the pressure existing in a first orifice (12) of entry (or exit) of the same valve; said valve is further provided with a device for regulating and limiting the pressure that supplies to the pilot piston (17) a control pressure between pre-established minimum and maximum values.

6 Claims, 2 Drawing Figures

Figure 1:
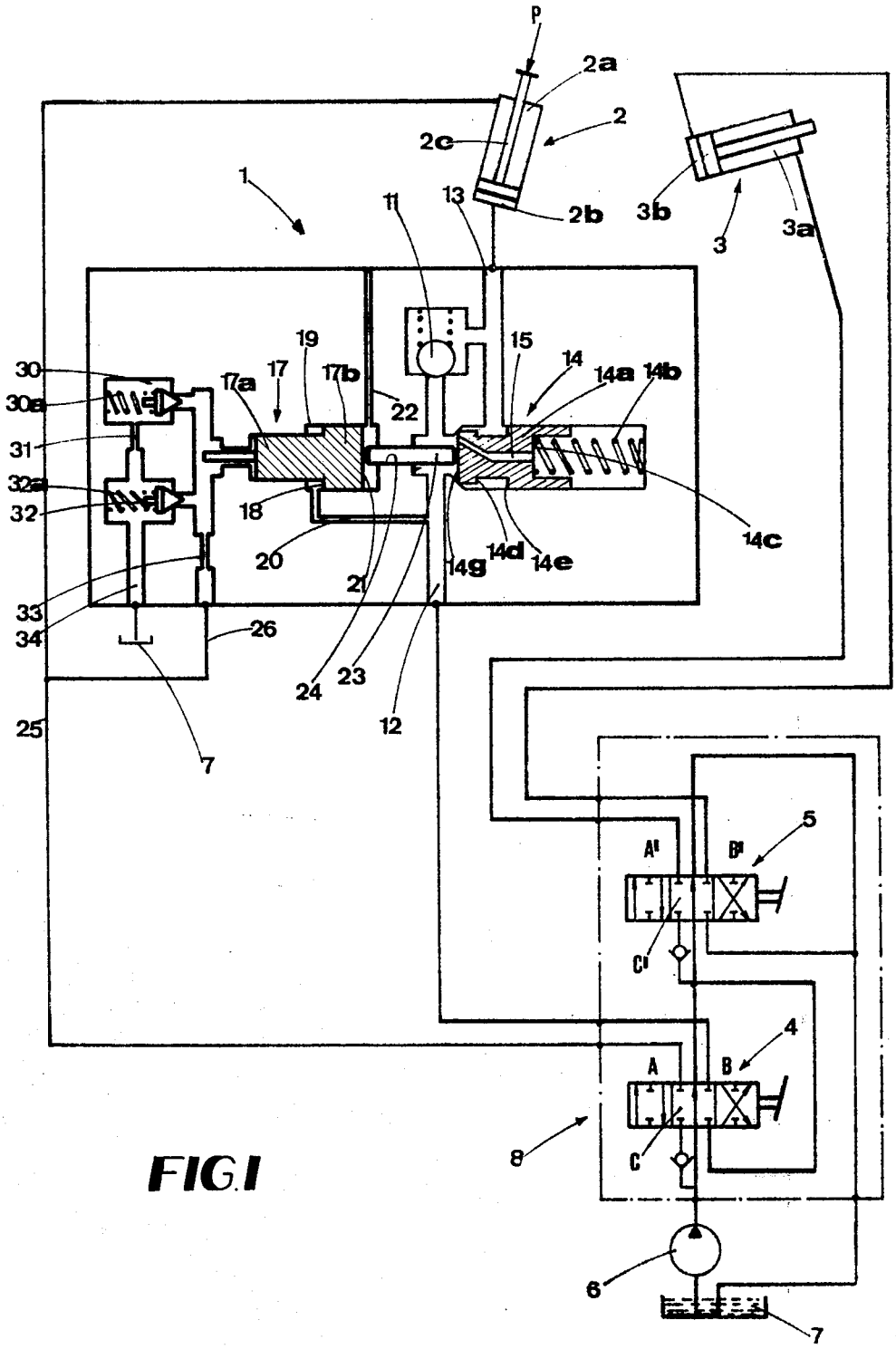

BALANCED VALVE WITH UNIDIRECTIONAL OLEO-DYNAMIC UNLOCKING, IN PARTICULAR TO ALLOW A NUMBER OF HYDRAULIC ACTUATORS TO BE SERIES CONTROLLED AT HIGH PRESSURE

The invention relates to an improved and balanced valve with unidirectional hydraulic unlocking, in particular to allow a number of hydraulic actuators to be series controlled at high pressure.

These valves are, in actual fact, valves of a complex type which allow the delivery to, for example, one chamber of a double acting jack which, in the detailed of the description below, will be referred to as a hydraulic actuator, just as if they were normal unidirectional valves, yet control the return from the said chamber both as a function of the pressure in the said chamber and as a function of the pressure of delivery to the other chamber.

The said types of valves are generally employed when it is feared that the piston of the jack may adopt a speed greater than it should at the time the oil is being delivered. This occurs when the piston is subjected to passive loads, such as for example, heavy weights that are displaced from the top downwards.

In such cases, without the presence of the said valves major overpressures would take place in the lower chamber of the jack or else there would be abrupt load drops, both of which are absolutely undesirable.

In the event it is desired to supply a number of jacks in series and, to synchronize their movements, with valves of a known type certain major difficulties occur. First and foremost, the said prior art valves are not suitable for operation when the discharge is to a high pressure surrounding, as in the case of series supplied jacks wherein the chamber in the first jack being discharged sends the fluid into the chamber of the second jack where delivery is being effected. Secondly, the delivery pressure in the first jack, which as stated controls the discharge of the valve, is the sum of the pressures on the first and on the second jacks, when they are series connected, and thus the piloting of the valve takes place in an abnormal fashion and brings about an irregular load drop.

The aforementioned difficulties are due to the structure of the said valves, a better description of which will be given below.

The fundamental object of the invention is to overcome the above mentioned difficulties by making available a balanced valve with unidirectional hydraulic unlocking that is able to discharge under pressure to allow the operation to be correct, and thus the load drop to be correct, even in cases when the pressure in the delivery branch does not correspond to the difference in pressure existing between the delivery and the return of the jack.

A further object of the invention is to make available a valve in which it is possible to regulate, over a given interval of time, the ratio between the pressure of delivery to the cylinder and the piloting pressure of the said valve.

Another object of the invention is to make available a valve that is constructionally simple, economical and of a high functional reliability.

These and other objects are all attained with the valve of the invention comprising: a check valve actuated by the pressure of the fluid entering from a first orifice and exiting from a second orifice; and a unidirectional valve with hydraulic unlocking that operates in the opposite flow direction of the fluid to that of the said first valve, the closing mechanism of which is subjected, in the closing direction, to the elastic thrust of a first spring suitably pre-loaded, in both directions, to the pressure existing in the said first orifice and, in the opening direction, to the pressure existing in the said second orifice which is operative only on a first surface of a pre-established extension, with which the said closing mechanism is provided. The said closing mechanism is thrust, in the opening direction, by the front part of a pilot piston driven by the pressure in the delivery pipe of the fluid exerting an effect on the rear part of the said piston. Important features of the valve forming the subject of the invention include that the said pilot piston is subjected, on a second surface of a pre-established area, to the pressure existing in the said first orifice which determines, on the said piston, a thrust that acts in the opening direction of the closing mechanism, the front part of the said piston being connected to atmospheric pressure and exerting an effect on the closing mechanism of the said second valve through the interposition of a stem. A device is provided for regulating and limiting the pressure, interposed between the said delivery pipe and the said pilot piston and designed to supply to the said piston a control pressure that is identical to the pressure in the delivery pipe up to a minimum pre-established delivery pressure valve. This control pressure is variable, in accordance with a pre-established law of proportionalities, from the said minimum value to a maximum pre-established delivery pressure value, and is approximately constant for delivery pressure values greater than the said maximum value.

Figure 2:
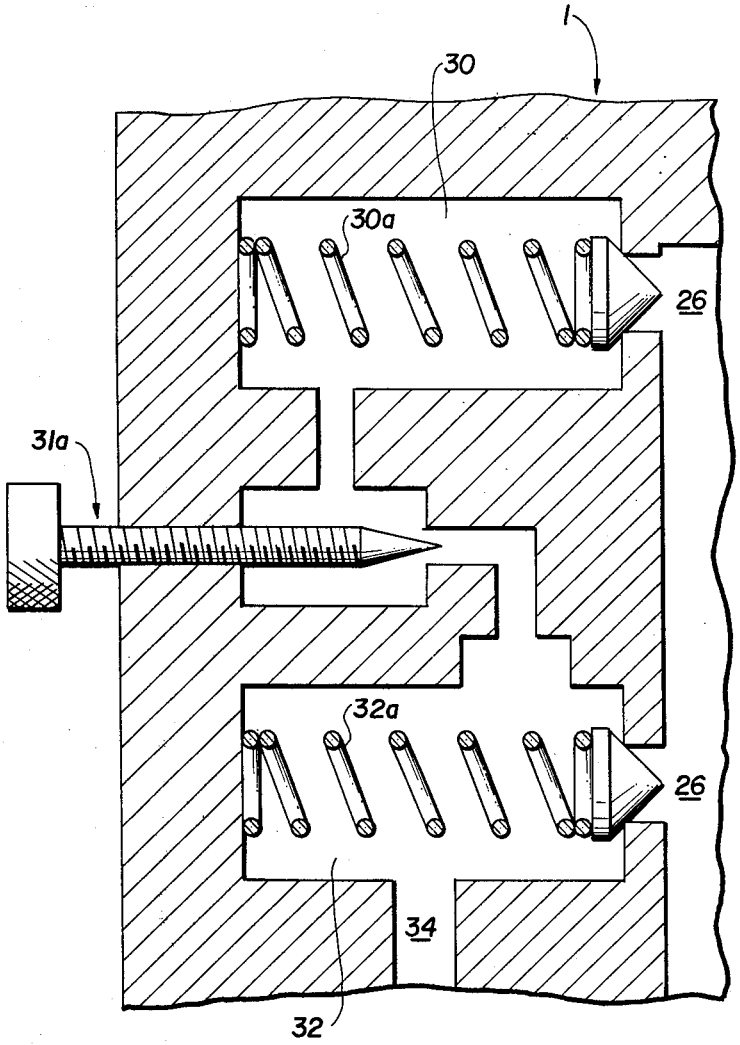

Further characteristics and advantages of the invention will emerge more obviously from the detailed description that follows of a preferred but not sole form of embodiment for the valve in question, illustrated purely as one example in the accompanying drawings, in which:

FIG. 1 shows, diagrammatically, inserted in a control circuit of two series connected hydraulic jacks, the valve of the invention, in which the details pertinent to a known valve are shown in thin lines, and those pertinent to the improved valve are shown in thick lines, and FIG. 2 is an enlarged showing of a detail.

The improved valve of the invention shown at (1), regulates the inflow or the discharge of fluid from the lower chamber **(2*b*) of a first hydraulic jack (2) which receives fluid, forthcoming from a tank (7) and put under pressure by a pump (6), via a distribution means (8) that comprises a first slide valve (4) with three positions, namely A, B and C, and a second slide valve (5)** with three positions, namely A', B' and C'.

The piston **(2*c*) of the jack (2) is subjected to a downward load (P). Via the distribution means (8), the fluid coming from either the upper chamber (2*a*) or the lower chamber (2*b*) of the jack (2), depending upon the positions of the slide valves (4) and (5), is sent either to the upper chamber (3*a*) or to the lower chamber (3*b*) of a second hydraulic jack (3) series connected with the said first jack (2)**.

The valve (1) comprises a check valve (11) that is actuated by the pressure of the fluid entering from a first orifice (12) and allows the fluid to exit from a second orifice (13). Furthermore, it comprises a unidirectional valve (14) with hydraulic unlocking that operates when the fluid enters from the orifice (13) and exits from the orifice (12), that is to say, when the direction in which the fluid flows is the reverse to that which opens valve (11).

The closing mechanism (14*a*) of the valve (14) is subjected to the elastic thrust of a first spring (14*b*), suitably pre-loaded, that exerts an effect on the lower part (14*c*) of the mechanism (14*a*) or, in other words, in the closing direction of valve (14).

Machined into the closing mechanism is a first annular surface (14*d*) and a second annular surface (14*e*) in facing juxtaposition to each other.The pressure on the orifice (13) thus exerts an effect on these in opposite directions. Surface (14*e*) is of a greater area than surface (14*d*) and thus, the pressure in the orifice (13) exerts a thrust in the opening direction of the valve (14) proportional to the difference between the areas of the surfaces (14*e*) less (14*d*).

The pressure existing in the orifice (12) exerts an effect on the front surface (14*g*) of the mechanism (14*a*) and also on the rear surface (14*c*) of the said mechanism (14*a*) since a through hole (15) is provided which places the orifice (12) in direct communication with the rear part of the closing mechanism.

Furthermore, the valve (1) comprises a composite pilot piston (17) constituted by a first piston part (17*a*) and by a second piston part (17*b*), the latter being of a greater area than the former and connected coaxially thereto, in such a way as to define or annular surface (18). The piston part (17*b*) effects a measured sliding movement inside a first cylindrical housing (19) that is connected, in the area of to the circular ring shaped surface (18), to the first orifice (12) via a pipe (20), and is connected, in the region of the free face (21) of the piston part (17*b*), to atmospheric pressure via a pipe (22). The face (21) of the piston (17) exerts an effect on the rear part of a stem (23) that effects a measured sliding movement inside a second cylindrical housing (24); the front part of the rod (23) exerts an effect on the front part (14*g*) of the closing mechanism (14).

Annular surface (18) constitutes a second surface on which, via the pipe (20), the pressure existing on the first orifice (12) exerts an effect. The said pressure generates on the piston (17) a thrust that is also applied in the opening direction of the closing mechanism (14*a*).

The area of annular surface (18) is equal to the sum of the difference between the annular surfaces (14*e*) and (14*d*) of the mechanism (14*a*), plus the area of the transversal face of the stem (23).

The rear part of the piston (17) is connected, via a linking pipe (26), to a pipe (25). Fitted to pipe 26 there is a device for regulating and limiting the pressure designed to provide the piston (17) with a control pressure that adopts values pre-established in relation to the pressure existing in the pipe (25). This control pressure is identical to the pressure in the pipe (25) up until when the pressure arrives at a minimum pre-established value; approximately constant for pressure values in the pipe (25) above a maximum pre-established value; and variable in accordance with a pre-established proportionality law for pressure values in the pipe (25) in between these minimum and maximum values.

The said regulating and limiting device comprises a first pressure relief valve (30) connected in parallel to the pipe (26) and provided with a second pre-loaded spring (30*a*). The valve (30) opens once the pressure in the pipe (26), and thus in the pipe (25), arrives at a minimum pre-established value determined by the pre-loading of the spring (30*a*) and places, via a pipe (34) provided with a first contraction (31), the pipe (26) in communication with the discharge (7). Furthermore, the device comprises a second pressure relief valve (32) connected in parallel to the pipe (26) and provided with a third pre-loaded spring (32*a*). The valve (32) opens once the pressure in the pipe (26) reaches a maximum value, related to a pre-established value for the pressure in the pipe (25), determined by the pre-loading of the spring (32*a*). When the valve (32) opens it places, via the pipe (34), the pipe (26) directly in communication with the discharge (7).

Series connected to the pipe (26), upstream with respect to the said pressure relief valves, is a second contraction (33). The proportionality law between the pressure in the pipe (25) and that in the pipe (26), in the pressure interval between the minimum and the maximum values, is determined by the area of the contractions (31) and (33) and by the coefficient of elasticity of the spring (30*a*).

The contraction (31) is shown in the figure as a fixed section. The addition may be envisaged, in order to vary the aforementioned proportionality law, of a needle valve 31*a*, shown in FIG. 2 of the drawing, that allows the area of the contraction (31) to be varied from a maximum value to a minimum value differing from zero. It is preferred to avoid the possibility of a complete closing of the contraction (31) or of needle valve 31 in order to prevent the discharge of the valve (30) from being impeded due to poor regulation.

So as to better explain the operation of the valve in question, reference is made to the hydraulic circuit illustrated in the figure, with the explanation of the operation and the connections in respect of the distributor means being taken for granted.

With the slide valves (4) and (5) in positions C and C′, neither of the jacks (2) and (3) is supplied with or discharges fluid.

When the slide valves are in positions B and B′, fluid is supplied to the chambers (2*b*) and (3*b*) of the jacks (2) and (3).

In this situation, the valve (1) operates, through the said valve (11), as a check valve. The closing mechanism of the valve (14) is kept in the closed position by the thrust of the spring (14*b*) and by the thrust that the delivery pressure at the orifice (12) exerts on the part (14*c*) of the mechanism (14*a*) which, as stated, is connected to the orifice (12) via the hole (15). The pre-loading of the spring (14*b*) is calculated in such a way that the said thrusts exceed the thrusts applied in the opening direction of the mechanism (14*a*).

When the slide valves (4) and (5) are in positions A and A′, the fluid under pressure is sent to the chamber (2*a*) via the pipe (25) which, in this case, is the delivery pipe. The stem (2*c*) moves downwards both under the action of the fluid and under that of the load (P).

The chamber (2*b*) discharges the fluid which enters the valve (1) via the orifice (13); the fluid exits from the valve (1) through the orifice (12) and is sent by the distribution means (8) to the jack (3).

The fluid that exits from the orifice (12) is, therefore, under pressure since it has to operate the jack (3).

The check valve (11) is obviously closed.

The thrust applied by the fluid under pressure, which enters from the orifice (13), on to the said first surface which, as will be recalled, is given by the difference of the areas of the annular surfaces (14*e*) and (14*d*), exerts an effect on the mechanism (14*a*) in the opening direction thereof, as does also the thrust applied by the pressure existing in the pipe (26) on to the piston (17). These thrusts in question are counteracted by the thrust of the spring (14*b*).

The thrusts, in the closing direction, applied by the pressure of the fluid at the orifice (12), on to the area difference between the surfaces (14*c*) and (14*g*) of the closing mechanism and on to the stem (23) are, instead, balanced by the thrust applied by the pressure of the fluid at the orifice (12) on annular surface (18) of the piston (17). In this way, one of the problems that known valves experience at the time the fluid under pressure is at the orifice (12), is overcome. The said problem arises when, as illustrated in the figure, a number of jacks are series connected. The said situation can also be found in cases when, despite there only being one jack, there is a distributor that has the center position closed (position C of the distributor (8)). In known valves, in fact, the pressure existing at the orifice (12), by applying on to the mechanism (14*a*) a thrust in the closing direction, prevents it from operating properly. In the case of jacks connected to a distributor in the fully closed position, dangerous pressures can be reached in the return branch of the jack since, even though provision may be made for a maximum pressure valve that is normally connected to the distributor, the said valve cannot start operating because the closing mechanism keeps, in the event of there being excessive pressure at the orifice (12), the valve of a known type in the closed position. The said pressure at the orifice (12), by exerting an effect on the piston (17), which in known valves reacts directly on to the mechanism (14*a*), renders the thrust applied by the piston on to the mechanism (14*a*) uncontrollable.

The pressure existing in the delivery pipe (25) exerts an effect, via the pipe (26), on to the rear part of the piston (17) and brings about a thrust in the opening direction of the closing mechanism (14*a*) of the valve (14).

When the pressure in the pipe (25) reaches the value at which the opening of the valve (30) commences, there is a flow of fluid that passes through the pipe (26) and is discharged via the said valve (30) and the contraction (31).

Load losses thus occur in the contractions (31) and (33) and in the valve (30) which determine in the pipe (26), downstream of the contraction (33), a different pressure from that existing in the pipe (25). In particular, an increase in the section of the contraction (31), a decrease in that of the contraction (33) and a lessening in the rigidity of the spring (30*a*) cause a still greater drop in the pressure in the pipe (26) with respect to the pressure in the pipe (25). Values of appropriate amplitudes have to be chosen to suit the breakdown of the loads envisaged between the jack (2) and the jack (3).

Once the pressure in the pipe (25) arrives at a value such as to determine a pressure in the pipe (26) that is able to bring about the opening of the valve (32), the pressure in the pipe (26) is stabilized and stays almost constant (at less than the load loss envisaged on the valve (32)). The maximum opening of the valve (14) corresponds to the pressure in question.

In this way the pressure that exerts an effect on the piston (17) and then on the closing mechanism (14*a*), and regulates the opening and the closing of the valve (14), is no longer the pressure of the delivery pipe (25) but another pressure, always proportional to the said pressure, though of lesser value.

Thus the second problem experienced with prior art valves of a known type is overcome, i.e., the problem of the regulation of the valves, for which a delivery pressure much greater than the pressure actually existing at the terminations of the jack (2) is applied, with a consequential intermittent drop in the load (P). The high pressure in the pipe (25) causes, in fact, the valve (14) to open excessively, with a consequential rapid fall in the load (P), with a consequential fast drop in the pressure in the chamber (2*a*) and thus in the pipe (25), with a consequential decrease in the thrust applied to the piston (17) and thus in the opening of the valve (14), with a consequential rise in the pressure in the chamber (2*b*) and thus an abrupt slowing down of the fall in the load (P), and with a consequential rise in the pressure in the pipe (25), which causes the whole above described phenomenon to start afresh.

In the invention valve, a rise or fall in the pressure at the orifice (12) does not bring about any change since the thrusts applied by the said pressure are, as stated, balanced. A rise in the pressure in the chamber (2*b*) and thus at the orifice (13), due to the load (P), tends to create an increase in the thrust, in the opening direction, on to the mechanism (14*a*) but causes a drop in the pressure in the chamber (2*a*) and thus in the pipe (25) and in the pipe (26), with a consequential decrease in the thrust, in the opening direction, on to the pilot piston (17), which tends to cause the valve (14) to re-close.

A variation, for example a rise in the delivery pressure, does not cause excessive overpressures in the chamber (2*b*) since the thrusts on both the piston (17) and on the mechanism (14*a*) tend to increase the opening of the valve (14).

In this way, by increasing or decreasing the delivery pressure, the discharge of the valve (1) is increased or decreased and thus the load dropping speed is increased or decreased and, at the same time, the said load drop is kept regular.

Should it not be wished to pilot the piston (17) with a pressure regulated on the basis of the delivery pressure, as in the case of one or more jacks in parallel provided with distributors with a fully closed position, the valve (1) can also not be equipped with the device for regulating and limiting the pressure and the psiton (17) can be directly subjected to the pressure existing in the pipe (25) in the rear part and to the pressure existing at the orifice (12), on to the annular surface (18).

Numerous modifications of a practical nature may be made to the invention as regards the constructional details thereof, without this in any way deviating from the framework of protection afforded to the conceptual ideas as claimed below.

What is claimed is:

1. An improved balanced valve with unidirectional hydraulic unlocking, in particular to allow a number of hydraulic actuators to be series controlled at high pressure, of the type comprising: a check valve (11) actuated by the pressure of the fluid entering from a first orifice (12) and exiting from a second orifice (13); and a unidirectional valve (14) with hydraulic unlocking that operates in the opposite flow direction of the fluid to that of the said first valve, said unidirectional valve (14) comprising closing mechanism (14*a*) which is subjected, in the closing direction, to the elastic thrust of a first pre-loaded spring (14*b*); and in both directions, to the pressure existing in the said first orifice (12) and, in the opening direction, to the pressure existing in the said second orifice (13) which is operative only on a first surface of a pre-established area with which the said closing mechanism is provided, the said closing mechanism being thrust, on the opening direction, by the front part of a pilot piston (17) driven by the pressure in a delivery pipe (25) of the fluid exerting an effect on the rear part of the said piston (17); various features of the valve being such that the said pilot piston is subjected, on a second surface of a pre-established area, to the pressure existing in the said first orifice which determines, on the said pilot piston, a thrust that acts in the opening direction of the closing mechanism, the front part of the said piston being connected to atmospheric pressure and exerting on effect on the closing mechanism of the said second valve through the interposition of a stem (23); and means for regulating and limiting the pressure, interposed between the said delivery pipe (25) and the said pilot piston (17) including means (30) to supply to the said piston (17) a control pressure that is identical to the pressure in the delivery pipe (25) up to a minimum pre-established delivery pressure value, including means (31), (31*a*), (33) to provide a variable pressure, in accordance with a pre-established law of proportionalities, from the said minimum value to a maximum pre-established delivery pressure valve, and including means (32) to provide an approximately constant delivery pressure for values greater than the said maximum value.

2. Valve according to claim 1, wherein the said pilot piston (17) comprises two coaxial piston parts (17*a*) and (17*b*), respectively, of different diameter, connected integrally one to the other so as to define an annular surface (18) that constitutes the said second surface, the cylinder of major diameter being made to effect a measured sliding movement inside a first cylindrical housing (19) connected, in the area corresponding to the said annular surface, to the said first orifice and, in the region of the free face of the said major diameter cylinder, to atmospheric pressure; the free face of the said major diameter cylinder exerting an effect on the rear part of the said stem which effects a measured sliding movement inside a second cylindrical housing.

3. Valve according to claim 1 or 2, wherein the area of the said second surface is identical to the sum of the difference between the areas of the rear surface (14*c*) and the area of the front surface (14*g*) subjected to the pressure existing in the said first orifice, of the said closing mechanism, plus the area of the transversal face of the said stem.

4. Valve according to claim 1, wherein the said regulating and limiting device comprises: a first pressure relief valve (30), connected in parallel to the pipe (26) that links the said delivery pipe with the said piston, designed to connect, via a first contraction (31) of a pre-established section, the said linking pipe with the discharge when the pressure in the linking pipe arrives at the said minimum value; and a second pressure relief valve (32), connected in parallel to the said linking pipe, designed to connect the said linking pipe directly with the discharge when the pressure in the linking pipe reaches the said maximum value.

5. Valve according to claim 1 or 4, wherein the said regulating device comprises a second contraction (33) of a pre-established section, series connected to the said linking pipe, upstream with respect to the said pressure relief valves.

6. Valve according to claim 1 or 4, wherein the section of the said first contraction is variable, through the addition of a needle valve, from a maximum value, corresponding to the full disengagement of the said needle valve up to a minimum pre-established value larger tha zero.

* * * * *